United States Patent [19]

Aliprandi

[11] 4,383,463

[45] May 17, 1983

[54] MUSICAL BELLOWS INSTRUMENT PROVIDED WITH AN ELECTRO-PNEUMATIC CONTROL DEVICE OPERATED BY THE BELLOWS MOVEMENT

[75] Inventor: Lucio M. Aliprandi, Ancona, Italy

[73] Assignee: Farfisa S.p.A., Ancona, Italy

[21] Appl. No.: 231,795

[22] Filed: Feb. 5, 1981

Related U.S. Application Data

[63] Continuation of Ser. No. 928,393, Jul. 27, 1978, abandoned.

[30] Foreign Application Priority Data

Jan. 4, 1978 [IT] Italy ..... 19028 A/78

[51] Int. Cl.[3] ..... G10D 11/00; G10H 1/46

[52] U.S. Cl. ..... 84/1.27; 84/376 EA; 84/DIG. 15

[58] Field of Search ..... 84/1.01, 1.04, 1.24, 84/1.27, 376 R, 376 EA, 1.14, 1.15, DIG. 15, DIG. 19

[56] References Cited

U.S. PATENT DOCUMENTS

| | | | |
|---|---|---|---|
| 3,406,243 | 10/1968 | Soprani | 84/1.27 |
| 3,918,343 | 11/1975 | Gumina | 84/376 EA |
| 4,043,242 | 8/1977 | Cavicchio | 84/1.01 X |

FOREIGN PATENT DOCUMENTS

| | | | |
|---|---|---|---|
| 394837 | 11/1973 | U.S.S.R. | 84/DIG. 15 |

*Primary Examiner*—Stanley J. Witkowski

*Attorney, Agent, or Firm*—Fidelman, Wolffe and Waldron

[57] ABSTRACT

Musical bellows instrument comprising an electro-pneumatic switching device, operated by the change in air pressure generated by the bellows movement to control a set of control gates for the registers, sets of registers or effect circuits of the musical instrument. The switching device comprises a fixed section secured to the instrument and a movable section secured to a flexible membrane sealing in an opening communicating with the interior of the bellows.

6 Claims, 8 Drawing Figures

MUSICAL BELLOWS INSTRUMENT PROVIDED WITH AN ELECTRO-PNEUMATIC CONTROL DEVICE OPERATED BY THE BELLOWS MOVEMENT

This is a continuation, of application Ser. No. 928,393, filed July 27, 1978, now abandoned.

This invention relates to a musical bellows instrument such as, for example, a reed accordion or an electronic accordion incorporating conventional reeds, wherein an electro-pneumatic switching device is provided for controlling one or more electrical or electronic circuits of the accordion, such as electronic registers or other effect circuits as the case may be.

In conventional accordions the bellows only perform the function of musical expression (air of different pressure on the reeds); accordingly, the change of registers or other effect circuits or devices has to be manually preset at the beginning of the musical performance. This does not allow any introduction of modifications or variations during the performance of the piece of music, unless moving the performer's hand away from the keyboard, thus rendering more difficult the use of the musical instrument.

It is the object of the present invention to provide a musical bellows instrument, as above defined, which is provided with an electro-pneumatic switching device operated by the bellows movement, by which one or more electrical or electronic circuits of the accordion can be controlled, for instance to provide systems or combinations of registers or effects resulting from the only action of the bellows. This device highly facilitates a performer, who is set free from the necessity of moving his (her) hands away from the keyboard to effect, for example, the change of one or more registers. The electro-pneumatic control device according to the present invention is suitable to control both the effects of the right hand and those of the left hand in an accordion.

The electrical control part or system of the electro-pneumatic switch according to the present invention may be of any nature, for example of electromechanical, electronic, photoresistive type or the like depending on requirements. Moreover, the switch may be effective in one, but preferably in both directions of the bellows movement, that is to say both in compression and suction.

Generally, according to the invention, a musical instrument has been provided of the type including a bellows means connected to side boxes, which comprises an electro-pneumatic device for the control of electrical or electronic circuits of the instrument, operated by the movement of the bellows and comprising an electrical switching device having a first portion secured or attached to one box of the instrument and a second movable control portion mechanically connected to a flexible diaphragm sealingly secured to said box at an opening communicating with the bellows interior.

The electro-pneumatic switching device according to the present invention may be used for controlling "on" and/or "off" operation of registers or other effect circuits (such as volume, brilliancy, fluttering, etc.) as preset by the performer or suitable programmed by the manufacturer. Moreover, said electro-pneumatic control device may be used for completely or partially disconnecting the electronic section of the accordion, leaving only the conventional reed section in operation, and also for controlling the connection or disconnection of the amplifying microphones for the sounds due to the convention reed section of the accordion.

The invention will now be further illustrated in connection with some exemplary embodiments as shown in the accompanying drawings, in which.

Figure 1:
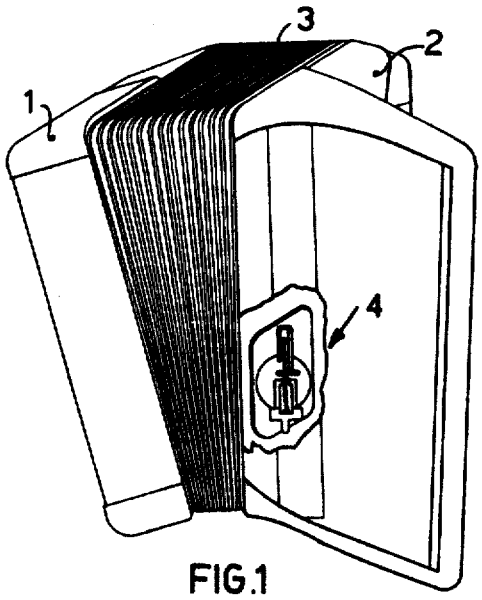
FIG. 1 shows a general type of accordion incorporating the electro-pneumatic control switching device according to the invention.

A general type of accordion is shown in FIG. 1 as comprising a side box 1 on which, for example, the right hand keyboard is applied, a second side box 2 on which, for example, the left hand keyboard is applied, and a bellows means 3 which, as well known, moves in both directions by relative removal and approach of the accordion boxes 1 and 2 to compress and/or suck air through the conventional reeds of the accordion.

The accordion also comprises an electro-pneumatic switching device 4 for controlling electrical or electronic circuits of the accordion, for example for controlling one or more registers, effect circuits or combinations thereof, the device being operated by the bellows movement, that is to say by the pressure and vacuum being built up inside the latter.

Figure 2:
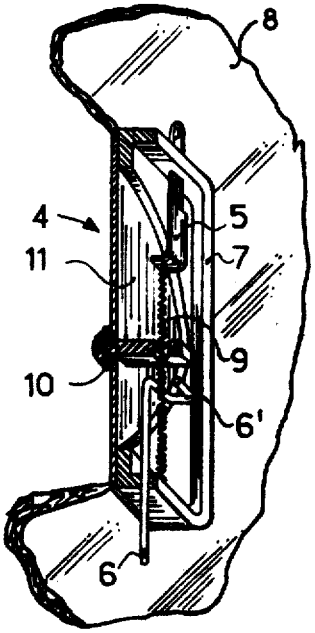
FIG. 2 shows an electromechanical embodiment for the electro-pneumatic control device shown in FIG. 1.

As depicted in the enlarged sectional view of FIG. 2, showing an electromechanical solution for the device, the latter comprises two opposing electrical contacts 5 and 6 firmly secured to a frame of electrically insulating material 7 forming as a whole the fixed section of the switching device, which is made fast or integral with the side closing board 8 of the bellows.

The electro-pneumatic control switching device further comprises a movable section substantially comprising, in this example shown, a contact spring 9 tensioned between a fixed contact, such as contact 5, and one side of frame 7 passing through the loop or U-bent end 6' of the other above mentioned fixed contact 6. Said contact spring 9 also passes through the hole of an insulating pawl 10 connected to a flexible diaphragm 11, such as a diaphragm of resilient material tensioned along the edges of frame 7 and sealingly secured at an opening in board 8 of the side closing box of bellows 3 to communicate with the interior of the latter.

As clearly shown in FIGS. 1 and 2, diaphragm 11 will follow the movement of said bellows in that, under the thrust or suction of air within the bellows, such a diaphragm will move rightwards or leftwards from an intermediate rest or inoperative position thereof. Therefore, it is apparent that in the example shown, wherein the diaphragm is at its intermediate position and said contact spring 9 does not close the circuit between fixed contacts 5 and 6, the bellows movement causes said diaphragm to move to an operative position, at which said spring 9 is brought to contact with said loop-bent end 6' of contact 6, thus closing the circuit. In the example shown, closure of contact occurs in both directions of movement of bellows 3, that is to say in the displacement direction of diaphragm 11, when the bellows compresses or decompresses the air therein. However, it will be appreciated that such a device could be of unidirectional type, or could close or open the circuit in only one direction of movement of said bellows.

Figure 3:
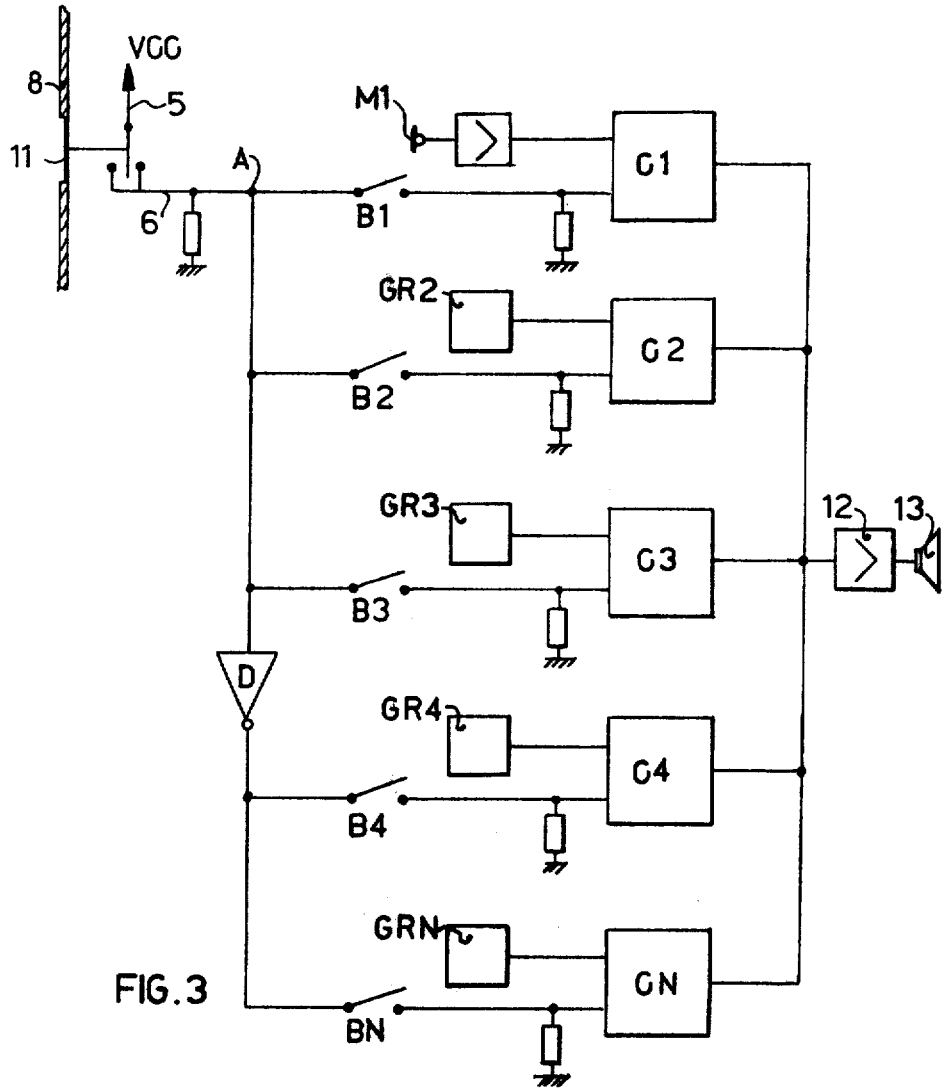
FIG. 3 is an electrical block diagram showing a possible application for the electro-pneumatic control device according to the invention.

The electric diagram relating to an application of the electro-pneumatic switching device as applied to an accordion according to the preceding figures of the drawings is shown in FIG. 3, in which such an electro-pneumatic switching device has been schematically shown.

As shown in said FIG. 3, the electro-pneumatic control device is connected at one side to a control voltage source Vcc, while at the other side is connected at A to a set of logic gates or analog control circuits C1, C2, C3, C4 and CN gating or not in accordance with the state thereof the passage of the output from a register or set of registers GR2, GR3, GR4 and GRN as well as, for example, the output from one or more microphones M1 for amplifying the sound of the conventional reeds of the accordion.

The logic control circuits C1–CN are parallel connected between the electro-pneumatic control switching device and a common output which in turn is connected, for example, to an amplifying block 12 for a loudspeaker or set of loudspeakers. Each of such logic or analog control circuits C1–CN are connected to the electro-pneumatic control switching device through a respective gating switch B1–BN which has to be manually preset at the beginning by the performer. As the case may be, an inverter D could be also provided in series with one or more control circuits.

The operation of the electro-pneumatic control device associated with the electrical diagram of FIG. 3 is as follows: assume, for example, switches B2 and BN at closed condition.

(A) When the bellows are not operated, switching device 4 remains at intermediate position, whereby no voltage reaches switch B2, accordingly logic or analog gate C2 does not allow the passage of the signal from GR2, and no signal from GR2 will appear at the output. Inverter D gives switch BN a positive voltage, as a result gating logic or analog gate CN, so that signal GRN reaches output U and is then amplified in amplifier 12 and reaches loudspeaker 13.

(B) When the bellows are operated, switching device 4 fast with diaphragm 11 is supplied with voltage Vcc and accordingly switch B2 is supplied with the voltage and as a result logic or analog gate C2 is gated and signal from GR2 is transmitted to output U. At the same time, the output of inverter D is grounded and supplied through switch BN this information to logic or analog gate CN. As a result, signal GRN is not supplied to output U.

When the bellows movement is stopped, the electro-pneumatic switch resets to its rest or inoperative condition and the following circuits reset as in the above described condition A.

In any case, it clearly appears that a performer should never move his or her hands away from the keyboard during the performance of a piece of music.

FIGS. 4 to 7 show some possible variants to the embodiment of the electro-pneumatic control device as applied to a musical bellows instrument according to the invention.

Figure 4:
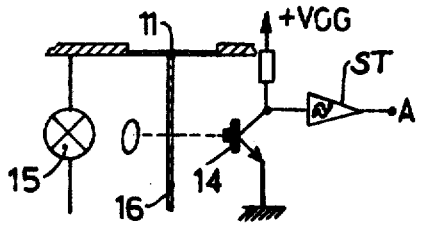
FIGS. 4 to 7 show further possible embodiments for the electro-pneumatic control switching device according to the invention.

A solution is shown in FIG. 4 as using a photoresistive system. Particularly, in the example of FIG. 4, use is made of a phototransistor 14 receiving the light from lamp 15 through an opening in a movable diaphragm 16 connected to diaphragm 11 of said electro-pneumatic control device. The emitter of this phototransistor is grounded, while the collector is connected through a load resistance to a control voltage Vcc and point A of the diaphragm of FIG. 3, respectively, through a Schmitt trigger ST. The operation of the device shown in FIG. 4 substantially corresponds to that of FIGS. 2 and 3, in that point A is supplied to voltage Vcc or to ground, respectively, depending on whether the phototransistor is subjected or not to the light from lamp 15 through the perforated diaphragm 16, the latter being controlled through diaphragm or membrane 11 by the movement of the bellows.

Figure 5:
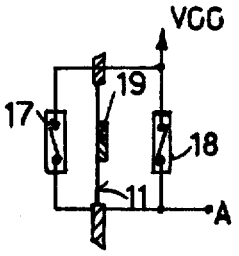

On the other hand, a solution is shown in FIG. 5 as using two opposing magnetic switches (such as reed switches) 17 and 18 on the two sides of membrane 11. A permanent magnet 19 is fast or integral with this membrane, which magnet on approaching said magnetic switches, due to the side displacement of the membrane, closes either of said switches, connecting the control voltage Vcc to one or more logic control circuits as, for example, described for the preceding cases. The magnetic switches are normally open when said membrane is at rest or inoperative condition.

Figure 6:
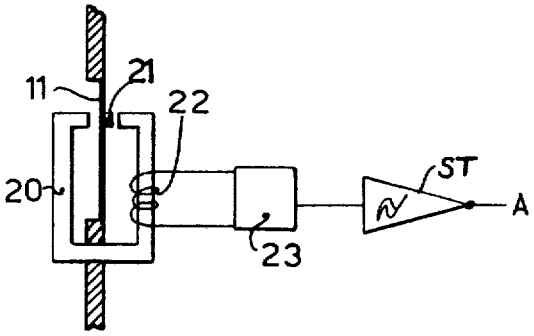

On the other hand, FIG. 6 shows an electromagnetic solution using a ferromagnetic yoke 20, between the pole pieces of which a flexible membrane is located and has a metal plate 21 secured thereto. The magnetic circuit of yoke 20 is linked with a winding 22 forming part of a triggering limit oscillator 23. This oscillator 23 is connected to a threshold trigger ST automatically detecting the oscillation condition thereof.

It should be noted that said oscillator is at oscillating state when the membrane is at rest or inoperative condition. When under the thrust or urge of air in the bellows the metal plate fast or integral with the membrane is moved close to one of the poles of the magnetic yoke, the oscillator ceases from oscillating. The threshold trigger, thereto connected, will give point A a voltage Vcc or a ground voltage, respectively, depending on whether the oscillator is oscillating or not. Therefore, point A can be alternatively connected to the electro-pneumatic switch shown in FIG. 3.

Figure 7:
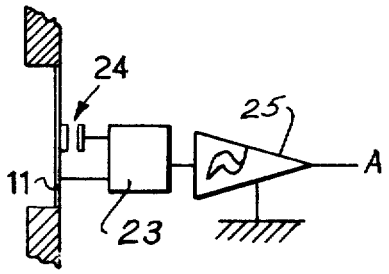

In FIG. 7 there is shown a final or last solution for the electro-pneumatic control device, which is sensitive or responsive to changes in capacitance. Thus, in the case of FIG. 7, the use is provided for a capacitive sensor 24, the movable section of which is connected to membrane 11, and which is also connected to an electronic device 23, the latter being responsive to change in capacitance to output a control voltage, as in the preceding cases. Also in the case of FIG. 7, the displacement of membrane 11, caused by the compression or depression movement of the musical bellows instrument, is detected by the capacitive sensor 24 to supply said control voltage. As apparent, any other type of sensor could be used instead of the above mentioned capacitive sensor, without departing for this from the inventive principle as above described.

Figure 8:
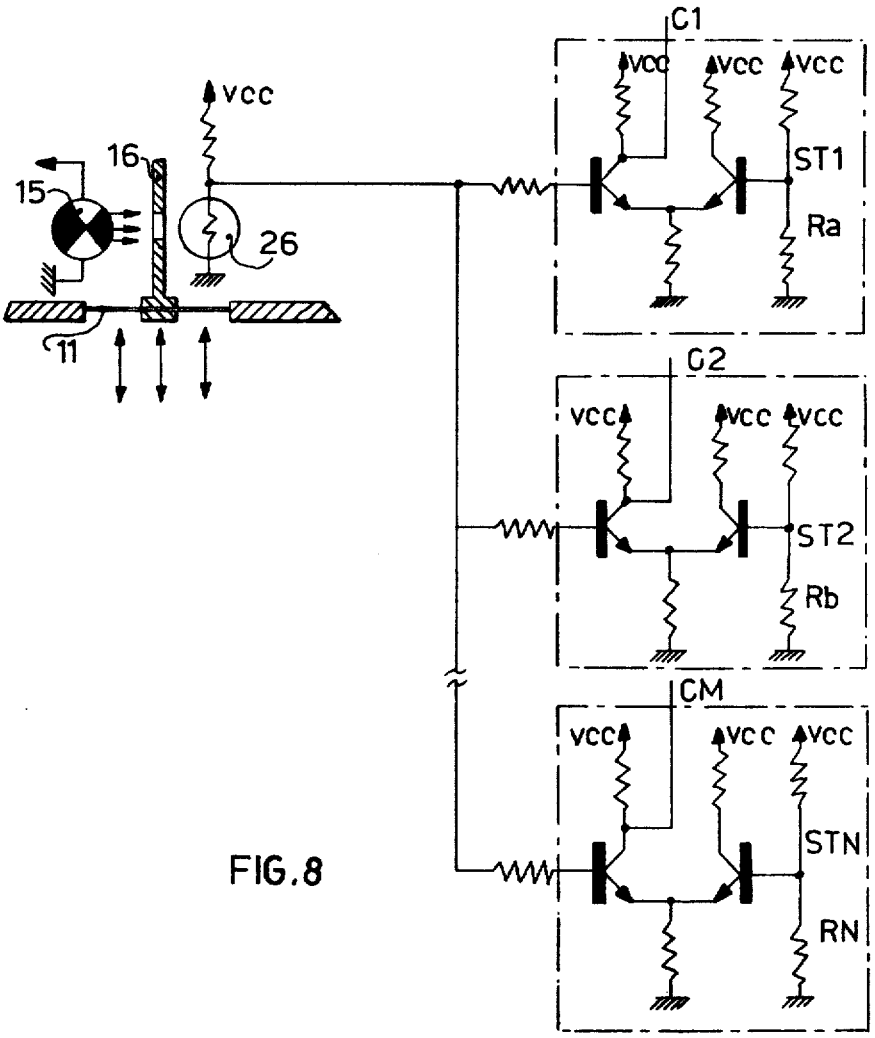
FIG. 8 shows the electrical diagram for a further application of the electro-pneumatic switching device according to the invention.

On the other hand, there is shown in FIG. 8 an exemplary embodiment, according to which as pressure or depression increases in the bellows, the electro-pneumatic control device gradually connects or disconnects, respectively, a still increasing number of combinations of logic or analog control circuits. For example, in the case of FIG. 8 use is made of an electro-pneumatic control device comprising a photoresistance 26 illuminated by a light source 15 through the perforated diaphragm 16 connected to flexible membrane 11. The electro-pneumatic control device is connected to the inputs to trigger circuits ST1, ST2, STN programmed at different threshold levels, giving proportionally increasing values to resistances Ra, Rb, RN. The output of each trigger is connected to the input of a respective logic or analog control circuit Cl–CN as above described. Therefore, it is apparent that a gradual displacement of membrane 11 in one direction or in opposite direction will cause a corresponding gradual change in the resistance of photoresistor 26 which, as a result, will be detected in triggers STl–STN, which will gradually supply the respective logic or analog control circuits Cl–CN, as in the preceding cases.

From the foregoing and as shown in the accompanying drawings, it will be understood that a musical bellows instrument having conventional reeds has been provided, to which an electro-pneumatic switching device has been applied, which device is operated by the movement of the bellows to control the connection or disconnection of one or more registers, sets or combinations of electronic registers and/or effect circuits of the musical instrument, as programmed by the manufacturer or programmable by the performer in accordance with requirements.

What is claimed is:

1. In a musical instrument having a keyboard and bellows for causing pressure differentials during contraction and expansion and reeds responsive to said pressure differentials to produce a musical output, a control for varying the volume of said musical output, special effects means for providing alteration outputs to alter said musical output and thus provide effects such as brilliancy, fluttering and the like, and preset switch means for presetting the special effects means to be used to alter said musical output, the improvement comprising:

a flexible membrane in communication with the interior of said bellows and responsive to said pressure differentials;

an electronic circuit comprising gate means for gating said alteration outputs to said musical output in accordance with a control voltage supplied through said preset switch means when said preset switch means is closed;

variable switch means connected to said flexible membrane and adapted to provide said control voltage through said preset switch means to enable and disable said gate means in accordance with the movement of said flexible membrane; and said variable switch means, present switch means, gate means, and special effect means integrated such that the special effects may be changed during playing of the instrument without the need for removal of the musician's hands from the keyboard.

2. An apparatus as in claim 1, wherein said electronic circuit further comprises:

register means for storage and supply of said alteration outputs to said gate means.

3. An apparatus as in claim 2, wherein said control voltage comprises a high signal level and a low signal level.

4. An apparatus as in claim 3, wherein said gate means comprises plural gates having their outputs connected in parallel and each gate having an enable input and an alteration input;

said register means comprising plural registers, each of said registers connected to a respective gate alteration input; and said preset switch means comprising plural switches, the output of each switch connected to a respective gate enable input and the inputs of said plural switches parallel connected to said variable switch means at a connection point, whereby respective alteration outputs are gated to said musical output in accordance with movement of said flexible membrane when a respective preset switch is closed.

5. An apparatus as in claim 4, and further comprising:

an inverter means located between the input of at least one of said plural switches and the input of at least one other of said plural switches to invert said control voltage supplied to said other switch, whereby at least one of said gates may be enabled by said low signal level and at least one other of said gates may be enabled by said high signal level.

6. An apparatus as in claim 4, and further comprising an amplifier means connected to an alteration input of one of said gates for supplying an altered volume output to said musical output.

* * * * *